US007062058B2

(12) United States Patent
Steeman et al.

(10) Patent No.: US 7,062,058 B2
(45) Date of Patent: Jun. 13, 2006

(54) CYLINDRICAL MICROPHONE HAVING AN ELECTRET ASSEMBLY IN THE END COVER

(75) Inventors: Michael G. M. Steeman, Castricum (NL); Hendrik Dolleman, Assendelft (NL); Paul C. van Hal, Hoorn (NL); Adrianus M. Lafort, Delft (NL); Jan Hijman, De Bilt (NL); Dion I. de Roo, Voorburg (NL); Auke P. Nauta, Hildesheim (DE); Raymond Mögelin, Alkmaar (NL)

(73) Assignee: Sonion Nederland B.V., Armsterdam (NL)

( * ) Notice: Subject to any disclaimer, the term of this patent is extended or adjusted under 35 U.S.C. 154(b) by 296 days.

(21) Appl. No.: 10/124,683

(22) Filed: Apr. 17, 2002

(65) Prior Publication Data

US 2002/0154790 A1 Oct. 24, 2002

Related U.S. Application Data

(60) Provisional application No. 60/301,736, filed on Jun. 28, 2001, provisional application No. 60/284,741, filed on Apr. 18, 2001.

(51) Int. Cl.
*H04R 25/00* (2006.01)

(52) U.S. Cl. ..... 381/369; 381/174; 381/361; 381/190; 381/191

(58) Field of Classification Search ..... 381/174, 381/190, 191, 369, 409, 410, 361, 398, 399, 381/424

See application file for complete search history.

(56) References Cited

U.S. PATENT DOCUMENTS 2,490,236 A 12/1949 Shaper ..... 171/327

(Continued)

FOREIGN PATENT DOCUMENTS

DE 43 29 99A A1 9/1995

(Continued)

OTHER PUBLICATIONS

Webster's Ninth New Collegiate Dictionary by Merriam-Webster Inc., 1985.*

(Continued)

*Primary Examiner*—Curt Kuntz
*Assistant Examiner*—Tuan D. Nguyen
(74) *Attorney, Agent, or Firm*—Jenkens & Gilchrist

(57) ABSTRACT

A microphone includes a separate end cover with a sound port. A diaphragm is directly attached to the end cover. The backplate is positioned within the housing against a ridge near an end of the housing. A spacer is positioned against the backplate. The diaphragm engages the spacer when the end cover, with its attached diaphragm, is installed in the housing. The backplate of the microphone has an integral connecting wire that is made of the same material as the backplate. The integral connecting wire may have an inherent spring force to provide a pressure contact with the accompanying electrical components. The integral connecting wire electrically couples the backplate to the electronic components within the housing and transmits the raw audio signal corresponding to movement of the diaphragm. The housing may have first and second ridges on which the printed circuit board and the electret assembly are mounted, respectively.

28 Claims, 8 Drawing Sheets

U.S. PATENT DOCUMENTS

| | | | | |
|---|---|---|---|---|
| 3,068,446 | A | 12/1962 | Ehrlich et al. | 340/8 |
| 3,775,572 | A | 11/1973 | Ishibashi et al. | 179/111 |
| 4,063,049 | A | 12/1977 | Pipitone et al. | 179/110 A |
| 4,142,073 | A * | 2/1979 | Agneus et al. | 381/174 |
| 4,550,227 | A | 10/1985 | Topholm | 179/107 E |
| 4,607,720 | A | 8/1986 | Hardt | 181/135 |
| 4,634,815 | A | 1/1987 | Marquis | 387/68.4 |
| 4,736,430 | A | 4/1988 | Schröder | 381/68.6 |
| 4,739,512 | A | 4/1988 | Hartl et al. | 381/68.6 |
| 4,764,690 | A * | 8/1988 | Murphy et al. | 307/400 |
| 4,850,023 | A | 7/1989 | Yarush | 381/67 |
| 4,852,177 | A | 7/1989 | Ambrose | 381/154 |
| 4,903,308 | A | 2/1990 | Paddock et al. | 381/202 |
| 4,993,072 | A | 2/1991 | Murphy | 381/113 |
| 5,048,090 | A | 9/1991 | Geers | 381/68.6 |
| 5,097,515 | A | 3/1992 | Baba | 381/191 |
| 5,220,612 | A | 6/1993 | Tibbetts et al. | 381/68 |
| 5,335,286 | A | 8/1994 | Carlson et al. | 381/191 |
| 5,373,555 | A | 12/1994 | Norris et al. | 379/430 |
| 5,408,534 | A | 4/1995 | Lenzini et al. | 381/191 |
| 5,530,763 | A | 6/1996 | Aebi et al. | 381/69 |
| 5,548,658 | A | 8/1996 | Ring et al. | 381/191 |
| 5,570,428 | A | 10/1996 | Madaffari et al. | 381/191 |
| 5,740,261 | A | 4/1998 | Loeppert et al. | 381/168 |
| 5,828,766 | A | 10/1998 | Gallo | 381/190 |
| 5,859,916 | A | 1/1999 | Ball et al. | 381/326 |
| 5,881,158 | A | 3/1999 | Lesinski et al. | 381/174 |
| 6,075,869 | A | 6/2000 | Killion et al. | 381/313 |

FOREIGN PATENT DOCUMENTS

| | | | |
|---|---|---|---|
| JP | 11266499 | A | 9/1999 |
| JP | 2000050394 | A | 2/2000 |
| WO | WO 00/41432 | A2 | 7/2000 |
| WO | WO 01/43489 | A2 | 6/2001 |

OTHER PUBLICATIONS

Microtronic, Product News and drawing for "Cylindrical Microphone Series 8000," 2 pages (Apr. 19, 2001).

* cited by examiner

CYLINDRICAL MICROPHONE HAVING AN ELECTRET ASSEMBLY IN THE END COVER

RELATED APPLICATIONS

This application claims the benefit of priority of U.S. Provisional Patent Application Nos. 60/301,736, filed Jun. 28, 2001, and 60/284,741, filed Apr. 18, 2001.

FIELD OF THE INVENTION

This invention relates to a miniature microphone with a housing that may have a generally cylindrical shape and includes a backplate with an integral connecting portion that connects to the electronics within the microphone.

BACKGROUND OF THE INVENTION

A conventional hearing aid or listening device includes a miniature microphone that receives acoustic sound waves and converts the acoustic sound waves to an audio signal. That audio signal is then processed (e.g., amplified) and sent to the receiver of the hearing aid or listening device. The receiver then converts the processed signal to an acoustic signal that is broadcast toward the eardrum.

Because it is desirable to make the receiver and microphone as small as possible so that they fit easily within the ear canal of the patient, there is a push to reduce the volume required for these devices. Numerous electroacoustic transducers are available which have a square shape. This square shape does not, however, result in an optimal use of space, and a larger volume is needed for the transducer.

There are also miniature microphones that have a cylindrical shape. While these cylindrical microphones may reduce the size, they often do so at the expense of performance or manufacturability. For example, the diaphragm may be too small, which decreases sensitivity, or the backplate may not be as proportionately large as the diaphragm, leading to an increase in parasitic capacitance. Furthermore, the positioning and mounting of the components within the cylindrical housing can be quite difficult.

Additionally, it is often difficult to make an electrical connection between the transducing assembly and the electronics within the microphone. Typically, this is performed by soldering a thin wire to both the transducing assembly and the electronics.

Therefore, a need exists for a microphone that has improved performance and can be manufactured and assembled more efficiently.

SUMMARY OF THE INVENTION

A microphone of the present invention includes a separate end cover with a sound port. A diaphragm, which undergoes movement in response to sound, is directly attached to the end cover. The backplate is positioned within the housing on a ridge that is adjacent to the diaphragm. A spacer is positioned against the diaphragm. The diaphragm engages the spacer when the end cover with the diaphragm attached thereto is installed in the housing. Preferably, the housing has a generally cylindrical shape and the end cover has a circular shape to fit onto one end of the housing.

In another aspect of the invention, the backplate of the microphone has an integral connecting wire made of the same material as the backplate. The integral connecting wire electrically couples the backplate to the electronic components within the housing that receives the raw audio signal corresponding to the movement of the diaphragm. This integral connecting wire may make electrical connection to the electronic components solely by the use of contact pressure.

In yet another aspect of the invention, the generally cylindrical housing has a first circumferential ridge at a first end and a second circumferential ridge at a second end. The printed circuit board is mounted on the housing on the first circumferential ridge. A portion of the electret assembly, typically the backplate, is mounted on the housing on the second circumferential ridge. The ridges may be formed by grooves extending into an exterior surface of the cylindrical housing, such that the grooves in the exterior surface receive a pair of O-rings for mounting the microphone in an external structure.

In a further embodiment, the microphone includes a transducing assembly with a flexible backplate to make the microphone more insensitive to vibration.

The above summary of the present invention is not intended to represent each embodiment or every aspect of the present invention. This is the purpose of the Figures and detailed description which follow.

BRIEF DESCRIPTION OF THE DRAWINGS

The foregoing and other advantages of the invention will become apparent upon reading the following detailed description and upon reference to the drawings.

Figure 1:
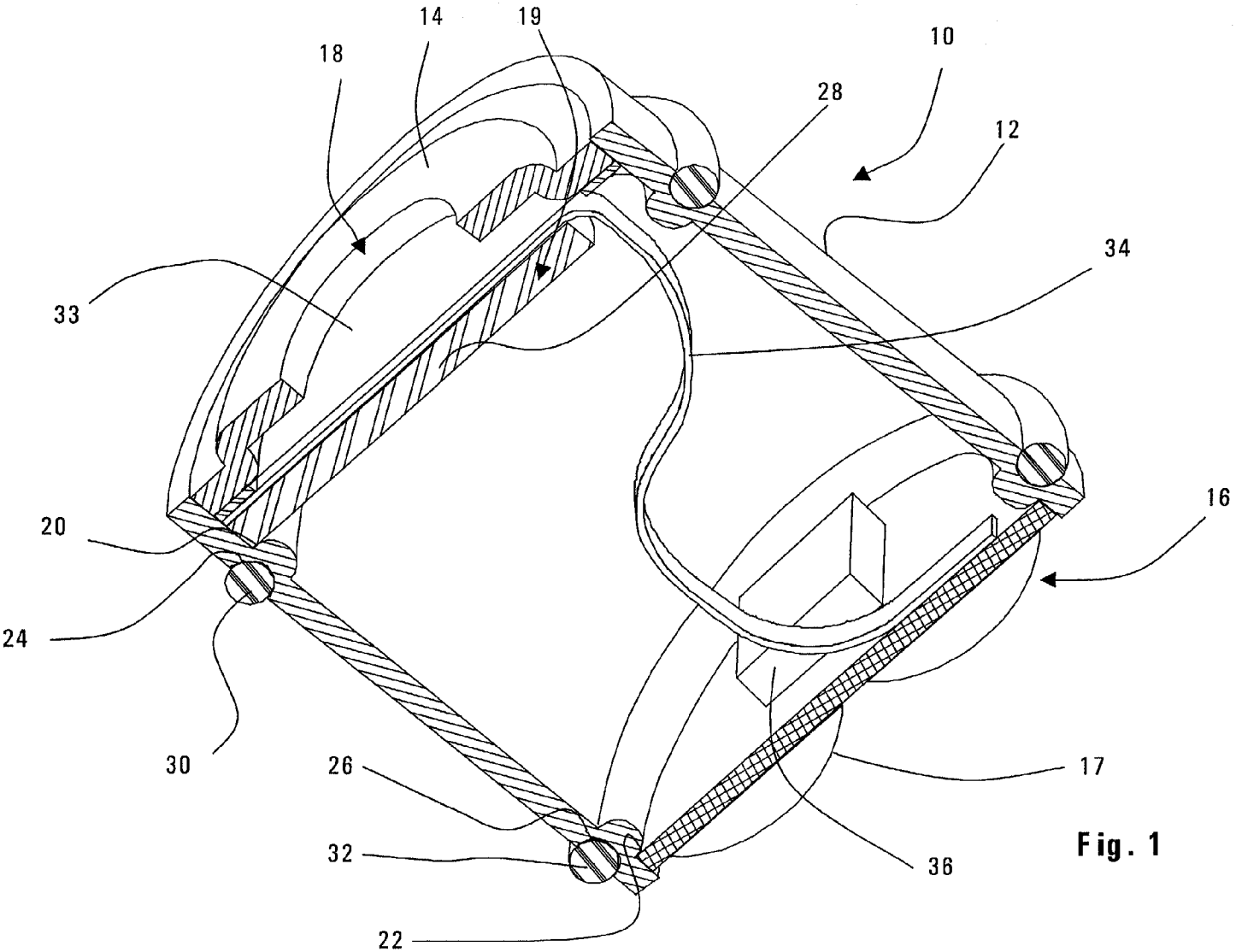
FIG. 1 is a sectional isometric view of the cylindrical microphone according to the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Referring to FIG. 1, a microphone 10 according to the present invention includes a housing 12 having a cover assembly 14 at its upper end and a printed circuit board (PCB) 16 at its lower end. While the housing 12 has a cylindrical shape, it can also be a polygonal shape, such as one that approximates a cylinder. In one preferred embodiment, the axial length of the microphone 10 is about 2.5 mm, although the length may vary depending on the output response required from the microphone 10.

The PCB 16 includes three terminals 17 (see FIG. 2) that provide a ground, an input power supply, and an output for the processed electrical signal corresponding to a sound that is transduced by the microphone 10. The sound enters the sound port 18 of the cover assembly 14 and encounters an electret assembly 19 located a short distance below the sound port 18. It is the electret assembly 19 that transduces the sound into the electrical signal.

The microphone 10 includes an upper ridge 20 that extends circumferentially around the interior of the housing 12. It further includes a lower ridge 22 that extends circumferentially around the interior of the housing 12. The ridges 20, 22 can be formed by circumferential recesses 24 (i.e., an indentation) located on the exterior surface of the housing 12. The ridges 20, 22 do not have to be continuous, but can be intermittently disposed on the interior surface of the housing 12. As shown, the ridges 20, 22 have a rounded cross-sectional shape.

The upper ridge 20 provides a surface against which a portion of the electret assembly 19 is positioned and mounted within the housing 12. As shown, a backplate 28 of the electret assembly 19 engages the upper ridge 20. Likewise, the lower ridge 22 provides a surface against which the PCB 16 is positioned and mounted within the housing 12. The ridges 20, 22 provide a surface that is typically between 100–200 microns in radial length (i.e., measured inward from the interior surface of the housing 12) for supporting the associated components.

Additionally, the recesses 24, 26 in the exterior surface of the housing 12 retain O-rings 30, 32 that allow the microphone 10 to be mounted within an external structure. The O-rings 30, 32 may be comprised of several materials, such as a silicon or a rubber, that allow for a loose mechanical coupling to the external structure, which is typically the faceplate of a hearing aid or listening device. Thus, the present invention contemplates a novel microphone comprising a generally cylindrical housing having a first ridge at a first end and a second ridge at a second end. A printed circuit is board mounted within the housing on the first ridge. An electret assembly is mounted within the housing on the second ridge for converting a sound into an electrical signal.

The backplate 28 includes an integral connecting wire 34 that electrically couples the electret assembly 19 to the electrical components on the PCB 16. As shown, the integral connecting wire 34 is coupled to an integrated circuit 36 located on the PCB 16. The electret assembly 19, which includes the backplate 28 and a diaphragm 33 positioned at a known distance from the backplate 28, receives the sound via the sound port 18 and transduces the sound into a raw audio signal. The integrated circuit 36 processes (e.g., amplifies) the raw audio signals produced within the electret assembly 19 into audio signals that are transmitted from the microphone 10 via the output terminal 17. As explained in more detail below, the integral connecting wire 34 results in a more simplistic assembly process because only one end of the integral connecting wire 34 needs to be attached to the electrical components located on the PCB 16. In other words, the integral connecting wire 34 is already in electrical contact with the backplate 28 because it is "integral" with the backplate 28.

Figure 2:
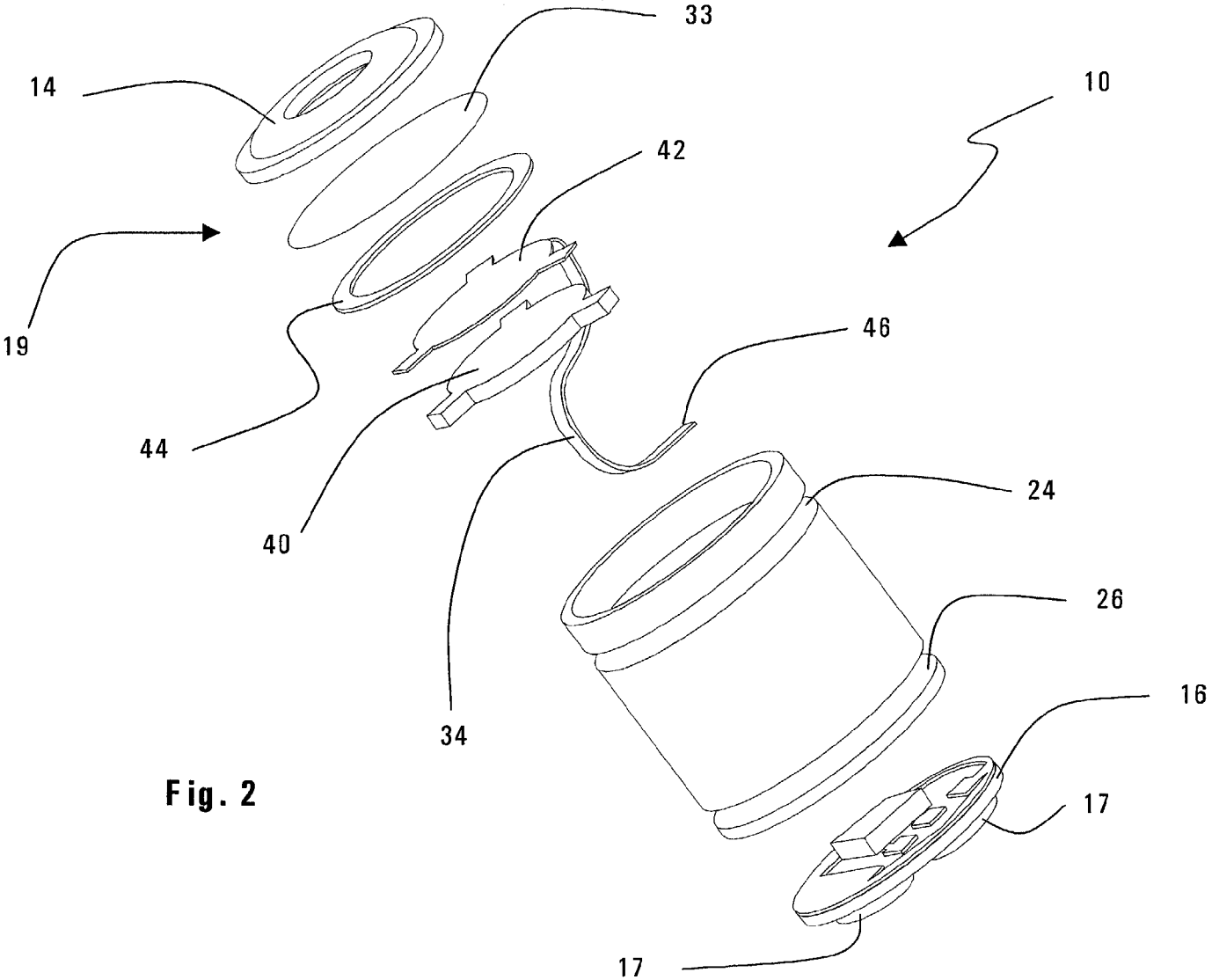
FIG. 2 is an exploded isometric view of the microphone of FIG. 1.

FIG. 2 reveals further details of the electret assembly 19. Specifically, the backplate 28 includes a base layer 40 which is typically made of a polyimide (e.g., Kapton) and a charged layer 42. The charged layer 42 is typically a charged Teflon (e.g., fluorinated ethylene propylene) and also includes a metal (e.g., gold) coating for transmitting signals from the charged layer 42. The charged layer 42 is directly exposed to the diaphragm 33 and is separated from the diaphragm 33 by an isolating spacer 44. The thickness of the isolating spacer 44 determines the distance between the charged layer 42 of the backplate 28 and the diaphragm 33. The diaphragm 33 can be polyethylene terephthalate (PET), having a gold layer that is directly exposed to the charged layer 42 of the backplate 28. Or, the diaphragm 33 may be a pure metallic foil. The isolating spacer 44 is typically a PET or a polyimide. The backplate 28 will be discussed in more detail below with respect to FIGS. 5A and 5B. Additionally, while the electret assembly 19 has been described with the backplate 28 having the charged layer 42 (i.e., the electret material), the present invention is useful in systems where the diaphragm 33 includes the charged layer and the backplate is metallic.

Figure 3:
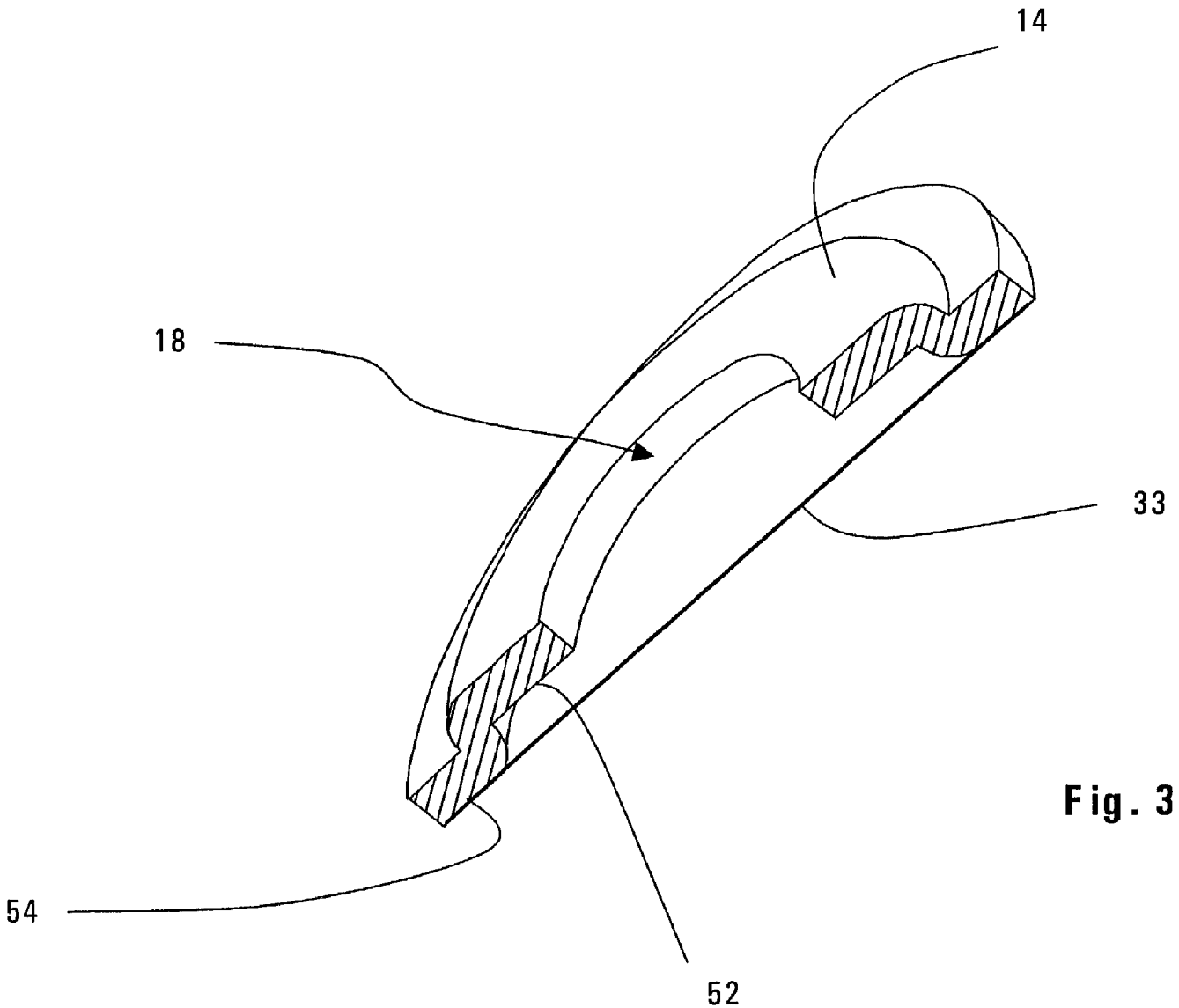
FIG. 3 is a sectional view of the cover assembly of the microphone of FIG. 1.

FIG. 3 illustrates the cover assembly 14 that serves as the carrier for the diaphragm 33, provides protection to the diaphragm 33, and receives the incoming sound. The cover assembly 14 includes a recess 52 located in the middle portion of the cover assembly 14. The sound port 18 is located generally at the midpoint of the recess 52. While the sound port 18 is shown as a simple opening, it can also include an elongated tube leading to the diaphragm 33. Furthermore, the cover assembly 14 may include a plurality of sound ports. The recess 52 defines an internal boss 54 located along the circular periphery of the cover assembly 14. The diaphragm 33 is held in tension at the boss 54 around the periphery of the cover assembly 14. The diaphragm 33 is typically attached to the boss 54 through the use of an adhesive. The adhesive is provided in a very thin layer so that electrical contact is maintained between the cover assembly 14 and the diaphragm 33. Alternatively, the glue or adhesive may be conductive to maintain electrical connection between the diaphragm 33 and the cover assembly 14. Because the cover assembly 14 includes the diaphragm 33, the diaphragm 33 is easy to transport and assemble into the housing 12.

In addition to the fact that the cover assembly 14 provides protection to the diaphragm 33, the recess 52 of the cover assembly 14 defines a front volume for the microphone 10 located above the diaphragm 33. Furthermore, the width of the boss 54 is preferably minimized to allow a greater portion of the area of the diaphragm 33 to move when subjected to sound. A smaller front volume is preferred for space efficiency and performance, but at least some front volume is needed to provide protection to the moving diaphragm. In one embodiment, the diaphragm 33 has a thickness of approximately 1.5 microns and a height of the front volume of approximately 50 microns. The overall diameter of the diaphragm 33 is 2.3 mm, and the working portion of the diaphragm 33 that is free of contact with the annular boss 54 is about 1.9 mm.

The cover assembly 14 fits within the interior surface of the housing 12 of the microphone 10, as shown best in FIG. 1. The cover assembly 14 is held in place on the housing 12 through a weld bond. To enhance the electrical connection, the housing 12 and/or cover assembly 14 can be coated with nickel, gold, or silver. Consequently, there is an electrical connection between the diaphragm 33 and the cover assembly 14, and between the cover assembly 14 and the housing 12.

Thus, FIGS. 1–3 disclose an assembling methodology for a microphone that includes positioning a backplate into a housing of the microphone such that the backplate rests against an internal ridge in the housing. The assembly includes the positioning of a spacer member in the housing adjacent to the backplate, and installing an end cover assembly with an attached diaphragm onto the housing. This installing step includes sandwiching the spacer member and the backplate between the internal ridge and the end cover assembly. Stated differently, the invention of FIGS. 1–3 is a microphone for converting sound into an electrical signal. The microphone includes a housing having an end cover with a sound port. The end cover is a separate component from the housing. The housing has an internal ridge near the end cover and a backplate is positioned against the internal ridge. The diaphragm is directly attached to the end cover. A spacer is positioned between the backplate and the diaphragm. When the end cover with the attached diaphragm is installed in the housing, the spacer and backplate are sandwiched between the internal ridge and the end cover.

Figure 4:
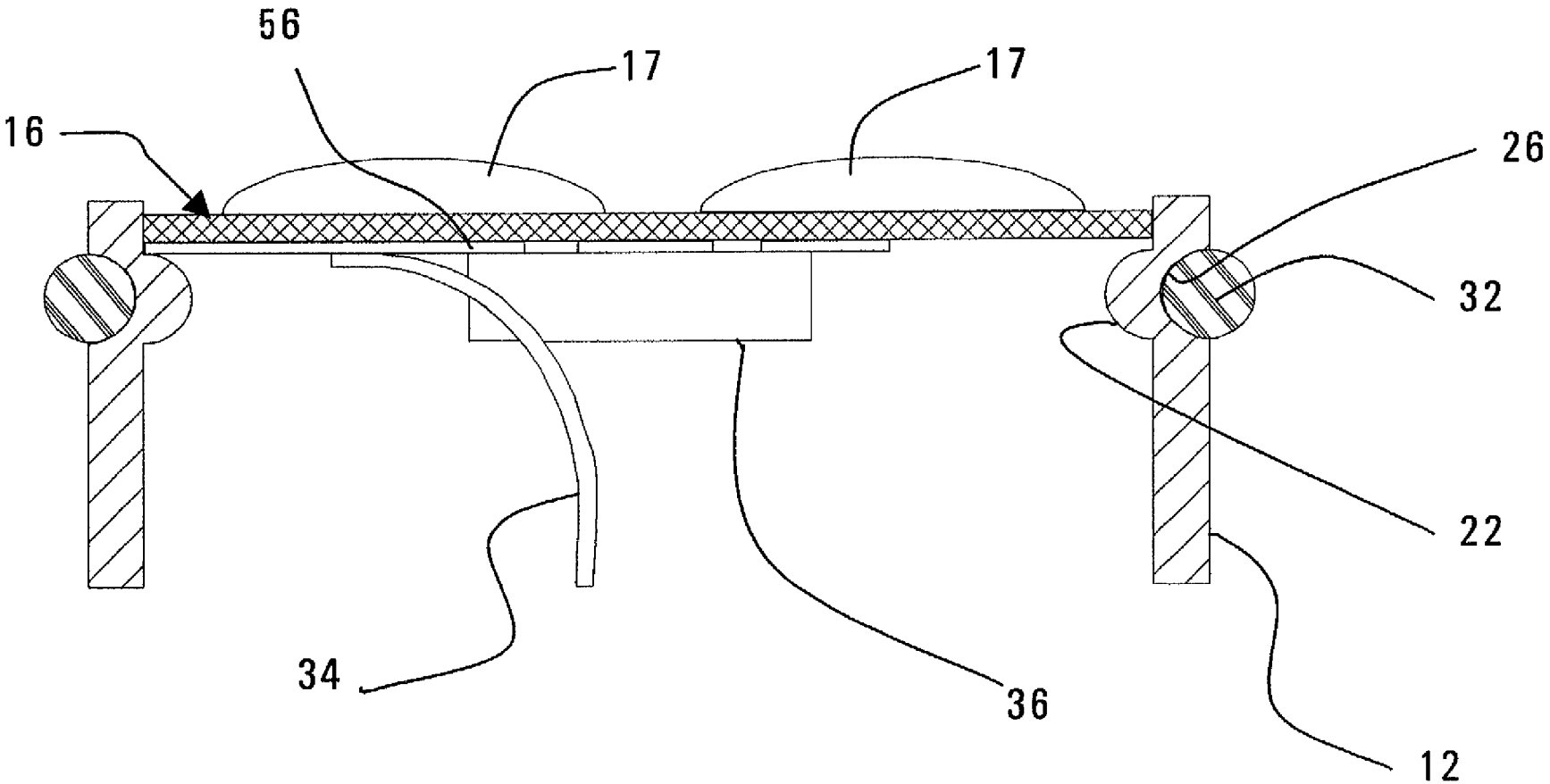
FIG. 4 is a sectional view of the printed circuit board mounted within the housing of the microphone of FIG. 1.

FIG. 4 is a cross-section along the lower portion of the microphone 10 illustrating the mounting of the PCB 16 on the lower ridge 22 of the housing 12. The integral connecting wire 34 extends from the backplate 28 (FIGS. 1 and 2) and is in electrical connection with the PCB 16 at a contact pad 56. This electrical connection at the contact pad 56 may be produced by double-sided conductive adhesive tape, a drop of conductive adhesive, heat sealing, or soldering.

The periphery of the PCB 16 has an exposed ground plane that is in electrical contact with the ridge 22 or the housing 12 immediately adjacent to the ridge 22. Accordingly, the same ground plane used for the integrated circuit 36 is also in contact with the housing 12. As previously mentioned with respect to FIG. 3, the cover assembly 14 is in electrical contact with the housing 12 via a weld bond and also the diaphragm 33. Because the diaphragm 33, the cover assembly 14, the housing 12, the PCB 16, and the integrated circuit 36 are all connected to the same ground, the raw audio signal produced from the backplate 28 and the output audio signal at the output terminal 17 are relative to the same ground.

The PCB 16 is shown with the integrated circuit 36 that may be of a flip-chip design configuration. The integrated circuit 36 can process the raw audio signals from the backplate 28 in various ways. Furthermore, the PCB 16 may also have an integrated A/D converter to provide a digital signal output from the output terminal 17.

Figure 5B:
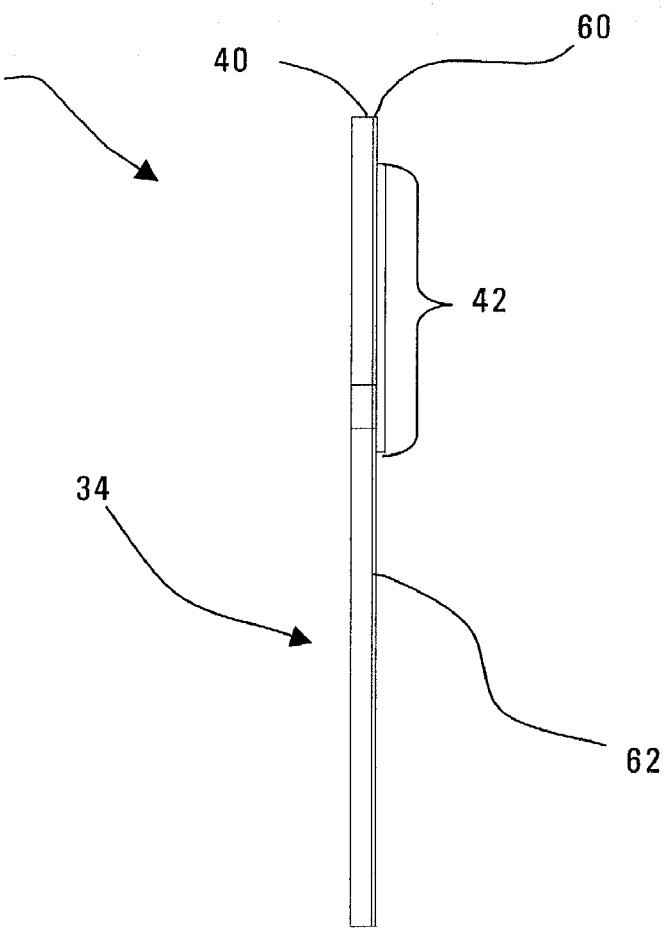
FIGS. 5A and 5B illustrate a top view and a side view of the backplate prior to being assembled into the cylindrical microphone housing of FIG. 1.
Figure 5A:
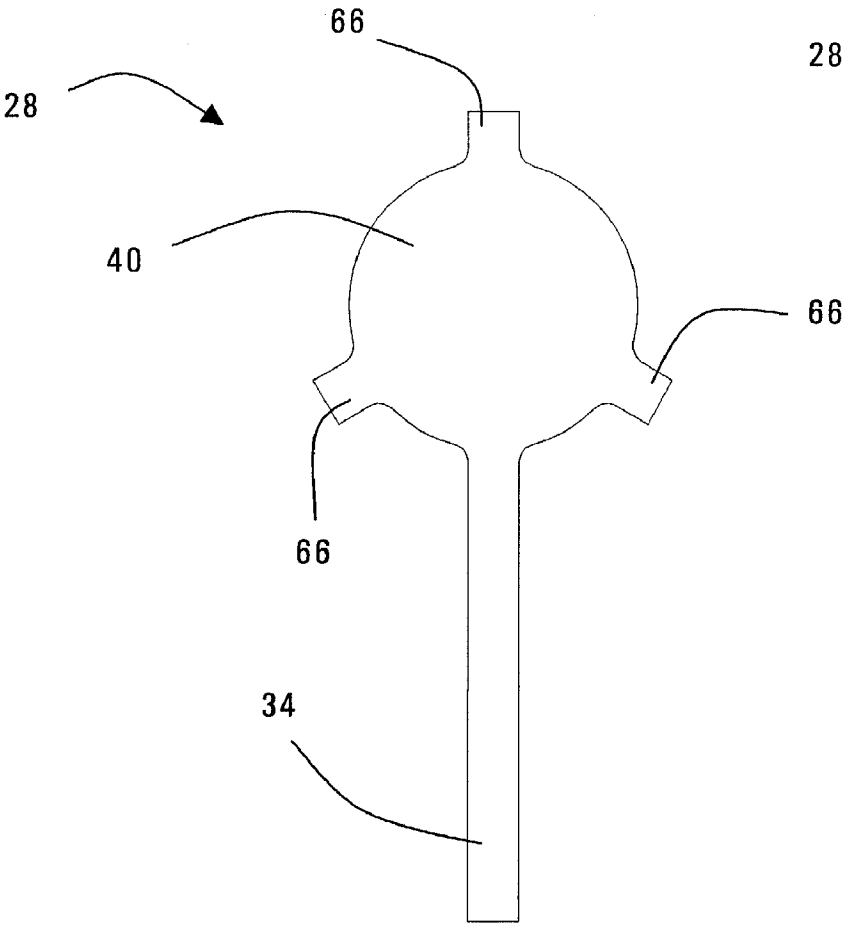

FIGS. 5A and 5B illustrate the backplate 28 in a top view and a side view, respectively, prior to assembly into the housing 12. The base layer 40 is the thickest layer and is typically comprised of a polymeric material such as a polyimide. The charged layer 42, which can be a layer of charged Teflon, is separated from the base layer 40 by a thin gold coating 60 that is on one surface of the base layer 40. To construct the backplate 28, the gold coating 60 on the base layer 40 is laminated to the charged layer 42, which is at that point "uncharged." After the lamination, the charged layer 42 is subjected to a process in which it becomes "charged." In one embodiment, the charged layer 42 is about 25 microns of Teflon, the gold layer is about 0.09 microns, and the base layer 40 is about 125 microns of Kapton.

The thin gold coating 60 has an extending portion 62 that provides the signal path for the integral connecting wire 34 leading from the backplate 28 to the PCB 16. The extending gold portion 62 is carried on the base layer 40. The integral connecting wire 34 has a generally rectangular cross-section. While the integral connecting wire 34 is shown as being flat, it can easily be bent to the shape that will accommodate its installation into the housing 12 and its attachment to the PCB 16.

Alternatively, the charged layer 42 may have the gold coating. In this alternative embodiment, the base layer 40 can terminate before extending into the integral connecting wire 34, and the charged layer 42 can extend with the gold coating 60 so as to serve as the primary structure providing strength to the extending portion 62 of the gold coating 60.

To position the backplate 28 properly within the housing 12, the base layer 40 includes a plurality of support members 66 that extend radially from the central portion of the base layer 40. The support members 66 engage the upper ridge 20 in the housing 12. Consequently, the backplate 28 is provided with a three point mount inside the housing 12.

A microphone 10 according to the present invention has less parts and is easier to assemble than existing microphones. Once the backplate 28 and the spacer 44 are placed on the upper ridge 20, the cover assembly 14 fits within the housing 12 and "sandwiches" the electret assembly 19 into place. The cover assembly 14 can then be welded to the housing 12. The free end 46 (FIG. 2) of the integral connecting wire 34 is then electrically coupled to the PCB 16, and the PCB 16 is then fit into place against the lower ridge 22. The integral connecting wire 34 preferably has a length that is larger than a length of the housing 12 to allow the integral connecting wire 34 to extend through the housing 12 and to be attached to the PCB 16 while the PCB 16 is outside of the housing 12. The PCB 16 is held on the lower ridge by placing dots of silver adhesive on the lower ridge 22. To ensure a tight seal and to hold the PCB 16 in place, a sealing adhesive, such as an Epotek adhesive, is then applied to the PCB 16.

Figure 6:
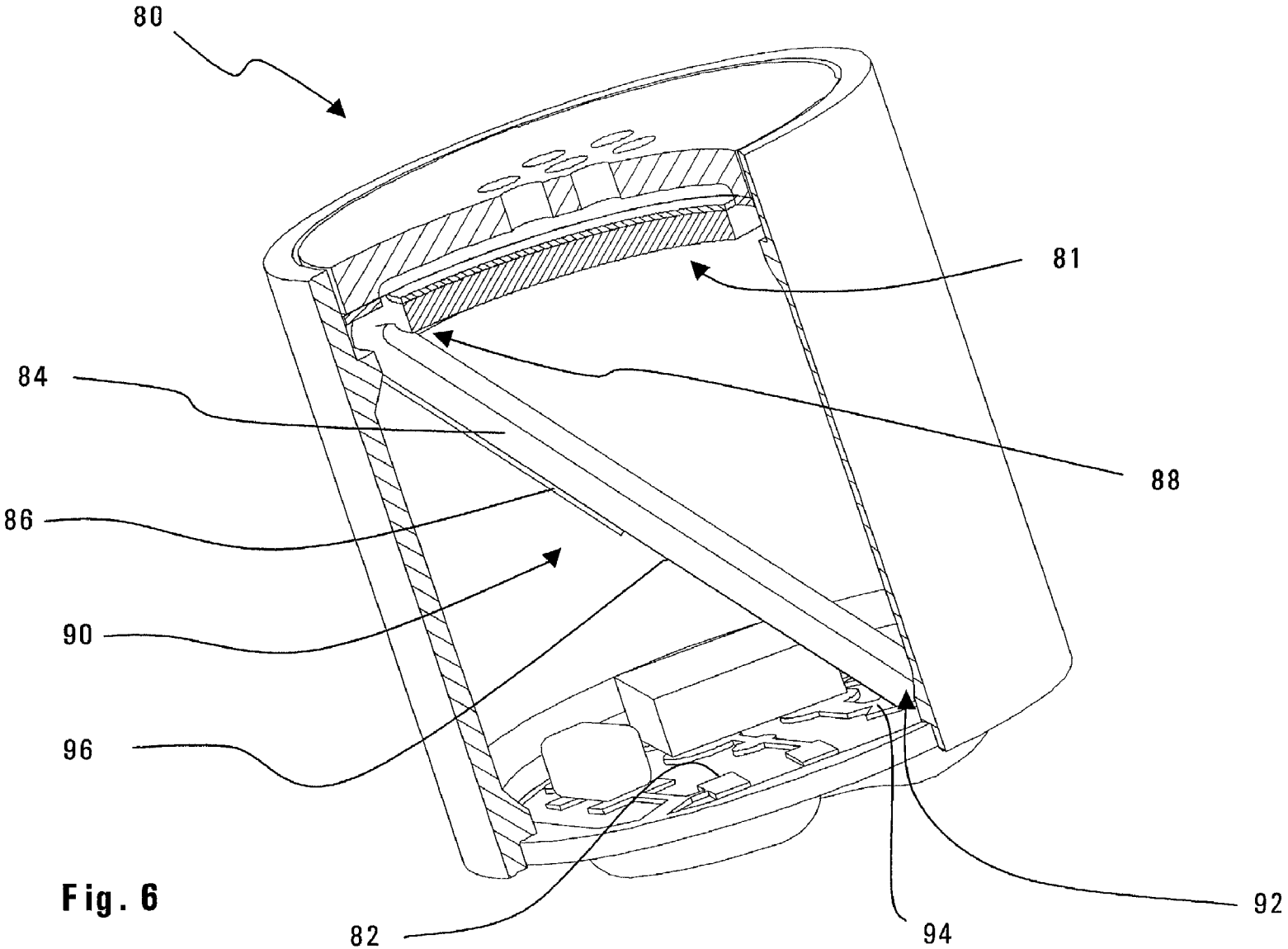
FIG. 6 illustrates an alternative embodiment where the integral connecting wire of the backplate provides a contact pressure engagement with the printed circuit board.

FIG. 6 illustrates a further embodiment of the present invention in which a microphone 80 includes an electret assembly 81 that provides a pressure-contact electrical coupling with a printed circuit board 82. While the specific materials can be modified, the electret assembly 81 preferably includes a backplate comprised of a Kapton layer 84, a Teflon layer 86, and a thin metallization (e.g., gold) layer (not shown) between the Kapton layer 84 and the Teflon layer 86, like that which is disclosed in the previous embodiments. A bend region 88 causes an integral connecting wire 90 to extend downwardly from the primary flat region of the backplate that opposes the diaphragm in the electret assembly 81. Because the Kapton layer 84 and the Teflon layer 86 are laminated in a substantially flat configuration, the bend region 88 tends to cause the integral connecting wire 90 to elastically spring upwardly towards the horizontal position. Accordingly, a terminal end 92 of the integral connecting wire 90 is in a contact pressure engagement with a contact pad 94 on the printed circuit board 82.

The spring force provided by the bend region 88 can be varied by changing the dimensions of the Kapton layer 84 and the Teflon layer 86. For example, the Kapton layer 84 can be thinned in the bend region 88 to provide less spring force in the integral connecting wire 90 and, thus, provide less force between the terminal end 92 of the integral connecting wire 90 and the contact pad 94. Because the Kapton layer 84 is thicker than the Teflon layer 86, it is the Kapton layer 84 that provides most of the spring force.

To ensure proper electrical contact between the terminal end 92 of the integral connecting wire 90 and the contact pad 94, at least a portion of the end face of the terminal end 92 must have an exposed portion of the metallization layer to make electrical contact with contact pad 94. As shown in FIG. 6, the exposed metallized layer is developed by having a lower region of the Teflon layer 86 removed so that the terminal end 92 includes a metallized portion 96 of the Kapton layer 84. The Teflon layer 86 can terminate at an intermediate point along the length of the integral connection wire 90, but preferably extends beyond the bend region 88 to protect the metallization layer. Further, the Teflon layer 96 may extend along a substantial portion of the length of the integral connecting wire 90 to protect against short-circuiting.

Figure 7:
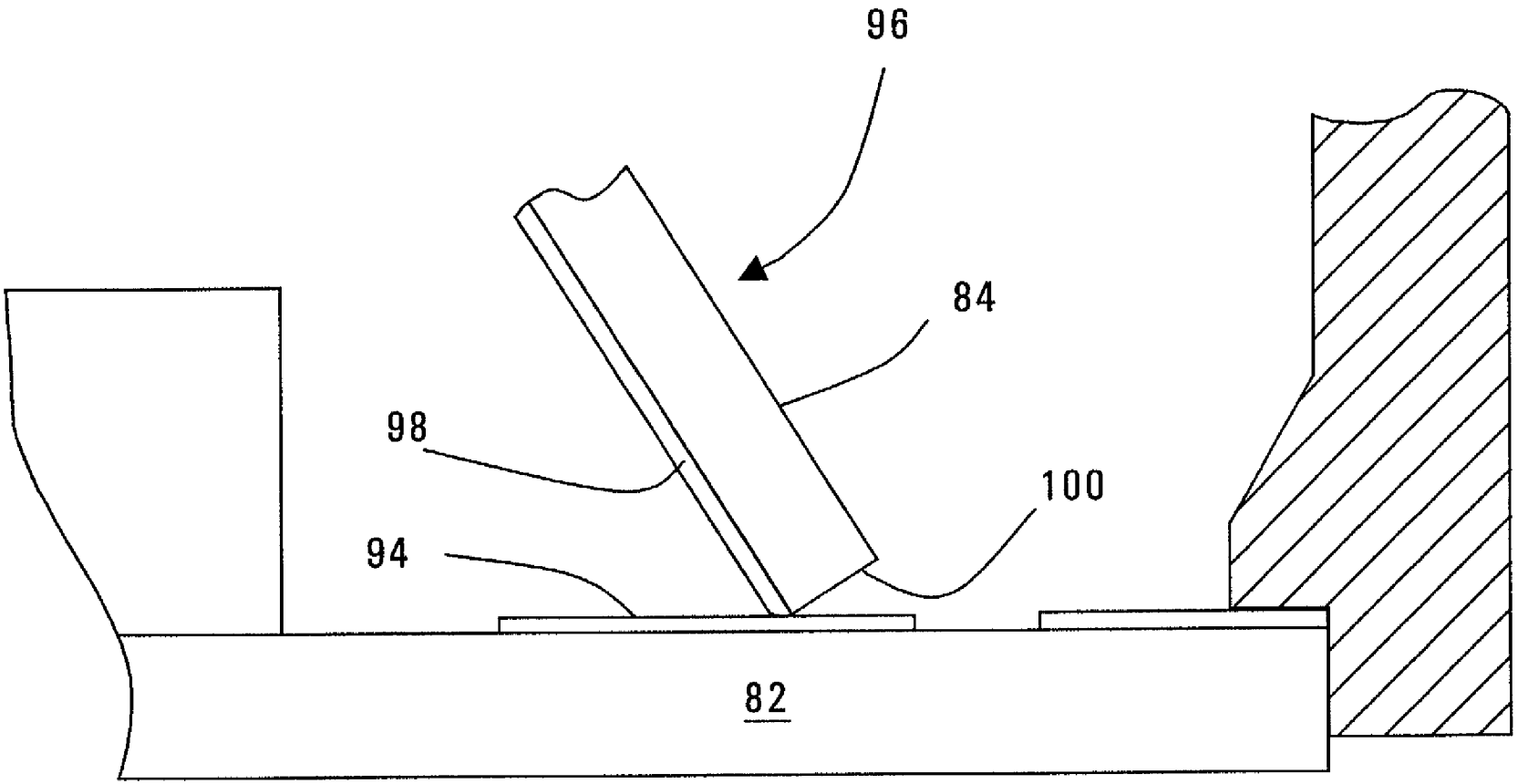
FIG. 7 is a side view of the electrical connection at the printed circuit board for the embodiment of FIG. 6.

FIG. 7 illustrates the detailed interaction between the metallized portion 96 of the Kapton layer 84 and the contact pad 94 on the PCB 82. Unlike FIG. 6, the metallization layer 98 is illustrated in FIG. 7 on the Kapton layer 84. Because the backplate is produced by a stamping process from the Kapton side, the metallization layer 98 gets smeared across the end face 100 of the Kapton layer 84 and has a rounded corner. This provides a larger contact area for the metallization layer 98 that helps to ensure proper electrical contact at the contact pad 94.

Figure 8:
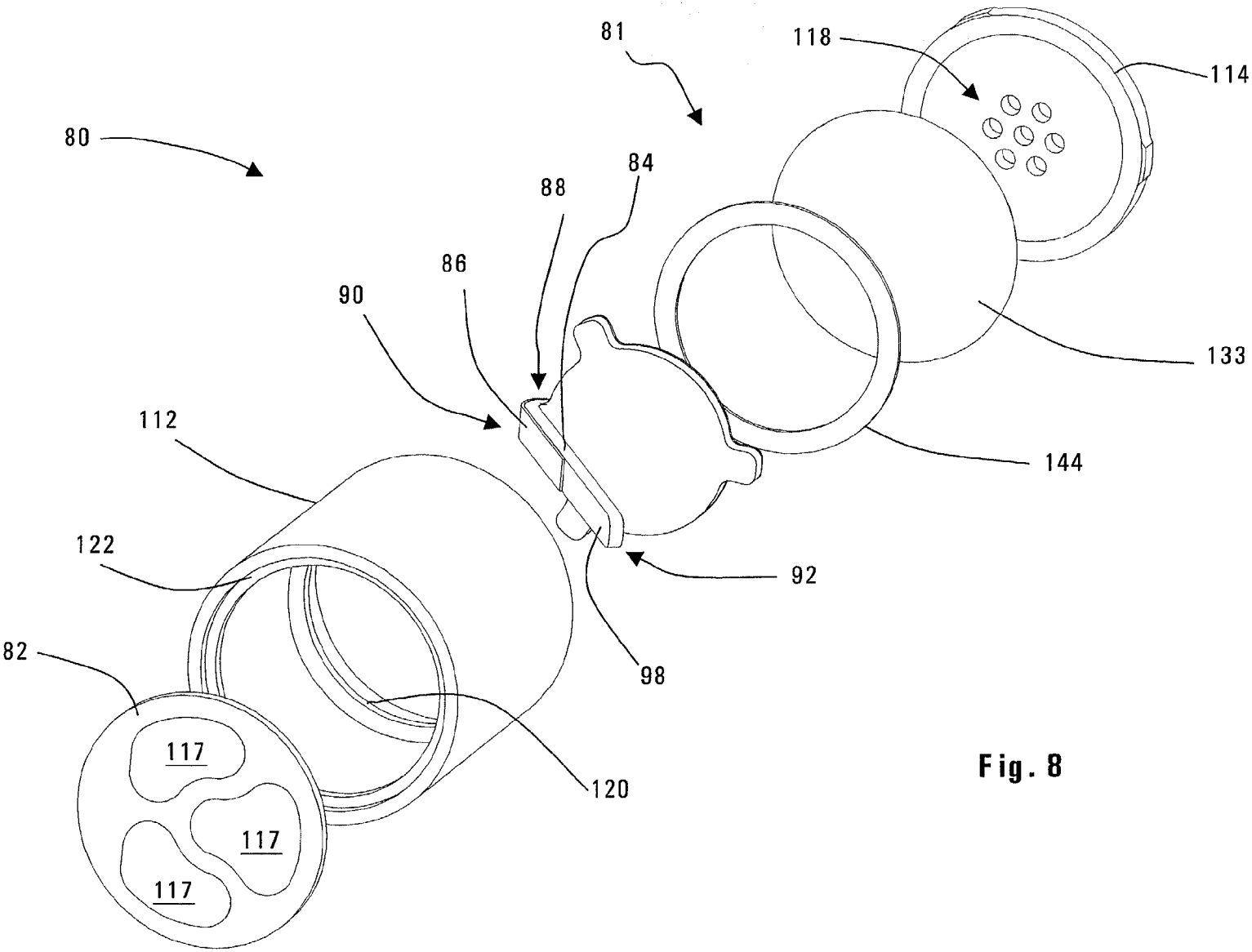
FIG. 8 is an exploded isometric view of the microphone of FIGS. 6 and 7.

FIG. 8 illustrates an exploded view of the microphone 80 in FIGS. 6 and 7, and includes the details of the various components. The microphone 80 has the same type of components as the previous embodiment. One end of the housing 112 includes the PCB 82 having the three terminals 117. The PCB 82 rests on a lower ridge 122 in the housing 112. The other end of the housing 112 receives the electret assembly 81. The electret assembly 81 includes the backplate with its integral connecting wire 90, a diaphragm 133, and a spacer 144. The end cover 114, which includes a plurality of openings 118 for receiving the sound, sandwiches the electret assembly 81 against the upper ridge 120 of the housing 112.

In a preferred assembly method, the electret assembly 81 is set in place in the housing 112 with the integral connecting wire 90 bent in the downward position such that an interior angle between the integral connecting wire 90 and the backplate is less than 90 degrees, as shown in FIG. 8. Then, the printed circuit board 82 is moved inwardly to rest on the lower ridge 122. During this step, the printed circuit board 82 is placed in a position that aligns the terminal end 92 of the integral connecting wire 90 with the contact pad 94. The inward movement of the printed circuit board 82 forces the terminal end 92 into a contact pressure engagement with the contact pad 94. Also, a drop of conductive epoxy could be applied to the contact pad 94 on the printed circuit board 82 to ensure a more reliable, long-term connection that may be required for some operating environments. The spacer 144 and the cover 114, including the attached diaphragm 133 force the backplate against the upper ridge 120.

In the arrangement of FIGS. 6–8, the number of steps required in the assembly process is reduced. And, the number of components required for assembly is minimized since it is possible to use no conductive tape or adhesive. Thus, the invention of FIGS. 6–8 includes a method of assembling a microphone, comprising providing an electret assembly, providing a printed circuit board, and electrically connecting the electret assembly and the printed circuit board via a contact pressure engagement that lacks a solder or adhesive bond.

This methodology of assembling a microphone can also be expressed as providing a backplate that includes an integral connecting wire, mounting the backplate within a microphone housing, and electrically connecting the integral connecting wire to an electrical contact pad via an elastic spring force in the integral connecting wire.

The backplates for the embodiments of FIGS. 1–8 may be rigid, but also may be relatively flexible to provide vibration insensitivity. When the backplate is rigid, the diaphragm moves relative to the backplate when exposed to external vibrations. This vibration-induced movement of the diaphragm produces a signal that is equivalent to a sound pressure of approximately 50–70 dB SPL per 9.8 $m/s^2$ (per 1 g). The vibration sensitivity relative to the acoustic sensitivity is a function of the effective mass of the diaphragm divided by the diaphragm area. This effective mass is the fraction of the physical mass that is actually moving due to vibration and/or sound. This fraction depends only on the diaphragm shape. For a certain shape, the vibration sensitivity of the diaphragm is determined by the diaphragm thickness and the mass density of the diaphragm material. Thus, a reduction in vibration sensitivity is usually accomplished by selecting a smaller thickness or a lower mass of the diaphragm. For a commonly used 1.5 micron thick diaphragm made of Mylar, the input referred vibration sensitivity would be about 63 dB SPL for a circular diaphragm.

If the rigid backplate is replaced with a flexible backplate, then the flexible backplate will also move due to external vibration. For low frequencies (i.e., below the resonance frequency of the backplate), this movement of the flexible backplate is designed to be in phase with the movement of the diaphragm. By choosing the right stiffness and mass of the backplate, the amplitude of the backplate vibration can match the amplitude of the diaphragm vibration and the output signal caused by the vibration can be cancelled. Further, because the backplate is made much thicker and heavier than the diaphragm, the backplate's acoustical compliance is much higher than the diaphragm's acoustical compliance. Thus, the influence of the flexible backplate on the acoustical sensitivity of the microphone is relatively small.

As an example, a polyimide backplate with a thickness of about 125 microns and a shape as shown in FIGS. 1–8 has a stiffness that is typically about two orders of magnitude greater than that of the diaphragm. The high stiffness prevents the backplate to move due to sound. The effective mass of the backplate in this example is about 50 times higher than the effective diaphragm mass and, thus, the vibration sensitivity is reduced by 6 dB. By adding some extra mass to the backplate, for example, by means of a small weight glued on its backside, the product of backplate mass and compliance can be matched to the diaphragm mass and compliance, and a further reduction of the vibration sensitivity can be achieved. The extra weight can also be added by configuring the backplate to have additional amounts of the material used for the backplate at a predetermined location.

Thus, the present invention contemplates the method of reducing the vibration sensitivity of a microphone. The microphone has an electret assembly having a diaphragm that is moveable in response to input acoustic signals and a backplate opposing the diaphragm. The method includes adding a selected amount of material to the backplate to make the backplate moveable under vibration without substantially altering an acoustic sensitivity of the electret assembly. Alternatively, this novel method could be expressed as selecting a configuration of the backplate such that a product of an effective mass and a compliance of the backplate is substantially matched to a product of an effective mass and a compliance of the diaphragm. The novel microphone having this reduction in vibration sensitivity comprises an electret assembly having a diaphragm that is moveable in response to input acoustic signals and a backplate opposing the diaphragm. The backplate has a selected amount of material at a predetermined location to make the backplate moveable under operational vibration experienced by the microphone.

While the present invention has been described with reference to one or more particular embodiments, those skilled in the art will recognize that many changes may be made thereto without departing from the spirit and scope of the present invention. By way of example, the PCB 16 or 82 could have a small hole in it to make the microphone 10 operate as a directional microphone. Each of these embodiments and obvious variations thereof is contemplated as falling within the spirit and scope of the claimed invention, which is set forth in the following claims.

What is claimed is:

1. A microphone for converting sound into an electrical signal, comprising:

a housing with a sound port for receiving said sound;

a diaphragm undergoing movement in response to said sound; and a backplate positioned at a predetermined distance from said diaphragm, said backplate having an integral connecting wire electrically coupling said backplate to an electronic component within said housing, said integral connecting wire including a layer of material that is the same material used in said backplate, said connecting wire being unitary with said backplate.

2. The microphone of claim 1, wherein said electronic component is an integrated circuit.

3. The microphone of claim 1, wherein said electronic component is located on a printed circuit board within said housing, said integral connecting wire being attached to a contact pad on said printed circuit board.

4. The microphone of claim 1, wherein said backplate includes a non-conductive structure and a conductive layer positioned on said non-conductive structure.

5. The microphone of claim 4, wherein said conductive layer is a layer of metal.

6. The microphone of claim 5, wherein said integral connecting wire includes said non-conductive layer and said metal layer.

7. The microphone of claim 4, wherein said non-conductive layer is polyimide.

8. The microphone of claim 1, wherein said integral connecting wire has a rectangular cross-section.

9. The microphone of claim 1, wherein said integral connecting wire includes a nonconductive layer and a conductive layer.

10. The microphone of claim 9, wherein said conductive layer is said same material as used in said backplate.

11. The microphone of claim 9, wherein said nonconductive layer is said same material as used in said backplate.

12. The microphone of claim 1, wherein said backplate includes a nonconductive layer, an electret layer, and a conductive layer.

13. The microphone of claim 1, wherein said diaphragm has an electret layer.

14. The microphone of claim 12, wherein said nonconductive layer is polyimide.

15. The microphone of claim 12, wherein said electret layer is fluorinated polyethylene propylene and said conductive layer is gold.

16. The microphone of claim 12, wherein said nonconductive layer is substantially thicker than said conductive layer.

17. The microphone of claim 1, wherein said integral connecting wire has a length that is larger than a length of said housing to allow said integral connecting wire to be attached to said electronic component outside of said housing.

18. A microphone for converting sound into an electrical signal, comprising:

a housing with a sound port for receiving said sound;

a diaphragm undergoing movement in response to said sound; and a backplate positioned at a predetermined distance from said diaphragm, said backplate having an integral connecting wire electrically connecting said backplate to an electronic component within said housing through contact pressure engagement, said integral connecting wire including a layer of material that is the same material used in said backplate, said connecting wire being unitary with said backplate.

19. The microphone of claim 18, wherein said electronic component is an integrated circuit.

20. The microphone of claim 18, wherein said electronic component is located on a printed circuit board within said housing, said integral connecting wire being in said contact pressure engagement with a contact pad on said printed circuit board.

21. The microphone of claim 18, wherein said integral connecting wire has a rectangular cross-section.

22. The microphone of claim 18, wherein said backplate includes a nonconductive layer, an electret layer, and a conductive layer.

23. The microphone of claim 18, wherein said diaphragm has an electret layer.

24. The microphone of claim 22, wherein said nonconductive layer is polyimide.

25. The microphone of claim 22, wherein said electret layer is fluorinated polyethylene propylene and said conductive layer is a metal.

26. The microphone of claim 24, wherein said integral connecting wire only includes said polyimide and said conductive layer at a terminal end where said contact pressure engagement occurs.

27. The microphone of claim 18, wherein said integral connecting wire is selected to have a thickness dimension that is different from said backplate to produce a desired amount of spring force for said contact pressure engagement.

28. The microphone of claim 27, wherein said selected thickness dimension is located at a bend region of said integral connecting wire.

* * * * *